US005620036A

United States Patent [19]

Grous

[11] Patent Number: 5,620,036

[45] Date of Patent: Apr. 15, 1997

[54] CHILD SAVER SCREEN APPARATUS

[76] Inventor: David E. Grous, 84 Laurel La., Ashford, Conn. 06278

[21] Appl. No.: 502,726

[22] Filed: Jul. 14, 1995

[51] Int. Cl.[6] ..... A47H 1/00

[52] U.S. Cl. ..... 160/89; 160/369; 160/179

[58] Field of Search ..... 160/87, 89, 104, 160/105, 106, 369, 370, 371, 381, 179, 390, 389, 399, 400, 402

[56] References Cited

U.S. PATENT DOCUMENTS

| | | | |
|---|---|---|---|
| 600,904 | 3/1898 | Beall | 160/179 X |
| 1,734,710 | 11/1929 | Borchert | 160/381 X |
| 3,053,566 | 9/1962 | Allen | 160/179 X |
| 3,321,885 | 5/1967 | Pratt | 160/381 X |
| 4,127,156 | 11/1978 | Brandt | 160/179 |
| 4,221,038 | 9/1980 | Singer et al. | 160/371 X |
| 4,333,284 | 6/1982 | Meadows | 160/179 X |

*Primary Examiner*—David M. Purol
*Attorney, Agent, or Firm*—Robert S. Smith

[57] ABSTRACT

A child saver safety screen apparatus for use with an associated window casing. The apparatus includes a first generally rectangular frame having a first side, a second side, a third side and a fourth side and a second generally rectangular frame having a first side, a second side, a third side and a fourth side. The apparatus also includes a plurality of fiber strands and a generally rectangular conventional window screen. The apparatus also includes apparatus for interlocking the second frame to the first frame. The apparatus also includes apparatus for mounting the plurality of fiber strands in substantially parallel relationship in the second frame and apparatus for connecting the conventional window screen to the second frame. The apparatus for interlocking the second frame to the first frame may include a first channel that connects to the inside edges of said first, second, and third sides of the first frame. The second frame may include a first J-shaped member and a second J-shaped member, each J-shaped member may include an elongated stem and an arcuate portion with the stems being fixed in closely spaced relationship and the arcuate portions spaced farther apart as viewed in cross section. The apparatus for connecting the plurality of strands to the second frame may include a plurality of wedge-shaped strand anchors. The apparatus for connecting the plurality of strands may place each of the fiber strands under tension to force the wedge-shaped anchors to lock into the second frame's wedge-shaped slot.

11 Claims, 3 Drawing Sheets

CHILD SAVER SCREEN APPARATUS

BACKGROUND OF THE INVENTION

The invention relates to screens and particularly to screen apparatus to prevent children and pets from falling out of windows. Conventional window screens available today are extremely flimsy and can not withstand much force exerted against them. Because the window screens can be pushed out rather easily, the odds of children and pets falling out of windows and getting seriously hurt are high.

The prior art includes conventional window screens attached to an aluminum frame. These screens either attach directly to the window casing by means of latches that are easily accessible to children or slide into a track in a storm window frame.

It is an object of the invention to provide apparatus that can withstand a force exerted against it and remain in place.

Another object of the invention is to provide apparatus that is easily removable in case of an emergency.

Yet another object of the invention is to provide apparatus that requires a minimum amount of labor to install on an existing window casing.

It is yet another object of the invention to provide apparatus that will fit any type or size of window manufactured.

Still another object of the invention is to provide apparatus which is inexpensive to manufacture.

SUMMARY OF THE INVENTION

It has now been found that these and other objects of the invention may be attained in an a child saver safety screen apparatus for use with an associated window casing that includes a first generally rectangular frame having a first side, a second side, a third side and a fourth side with the first side second side, third side and fourth side each having respective outside edges and inside edges. The apparatus also includes a second generally rectangular frame having a first side, a second side, a third side and a fourth side; the first side, second side, third side and fourth side are joined together with respective corner splines. The apparatus also includes a plurality of fiber strands and a generally rectangular conventional window screen. The apparatus also includes means for interlocking the second frame to the first frame. The apparatus also includes means for mounting the plurality of fiber strands in substantially parallel relationship in the second frame and means for connecting the conventional window screen to the second frame.

In some forms of the invention the means for interlocking the second frame to the first frame includes a first channel that connects to the inside edges of the first, second, and third sides of the first frame. The first channel may have a C-shape cross section and a first end and a second end. The first C-shaped channel may include spurs located on the first end and the second end of the first C-shaped channel; the spurs may extend inwardly toward the first C-shaped channel.

The second frame may include a first J-shaped member and a second J-shaped member, each J-shaped member may include an elongated stem and an arcuate portion with the stems being fixed in closely spaced relationship and the arcuate portions spaced farther apart as viewed in cross section, resulting in the first and second J-shaped members forming a second C-shaped channel. The first J-shaped member and the second J-shaped member may have the stems thereof disposed to define a wedge-shaped slot. The means for interlocking may further include the second frame sliding into the first frame whereby the arcuate portions of the first and second J-shaped members of the second frame lock with the C-shaped channel and spurs of the first frame.

The means for connecting the plurality of strands to the second frame may include a plurality of strand anchors. The strand anchors may be wedge-shape. Each of the plurality of strand anchors may have a hole therethrough with a counter sink and a vertical slot with the hole located between the two parallel sides of the wedge-shaped strand anchor and the counter sink located on the parallel side of the strand anchor having the larger cross-sectional area. The vertical slot may pass through the center of the counter sink and hole.

The means for connecting the plurality of fiber strands may further include the fiber strands passing through the second C-shaped channel of the second frame, through the hole and counter sink in the strand anchors, with the means for connecting placing each of the fiber strands under tension to force the wedge-shaped strand anchors to lock into the wedge-shaped slot in the second frame. The plurality of fiber strands may be disposed in first and second sets with each set being generally mutually parallel and the first set being substantially perpendicular to the second set.

The means for connecting the standard window screen to the second frame may include a first projection and a second projection. The first and second projections may be located on the first J-shaped member of the second frame. The first projection and the second projection may be disposed generally parallel to each other, forming a U-shaped slot between the first and second projections as viewed in cross-section. The U-shaped slot may be generally dimensioned and configured to accept an associated vinyl spline. The associated window screen may be held in place on the second frame by the associated vinyl spline pressed into the U-shaped slot.

BRIEF DESCRIPTION OF THE DRAWING

The invention will be better understood by reference to the accompanying drawing in which.

DESCRIPTION OF THE PREFERRED EMBODIMENT

Figure 1:
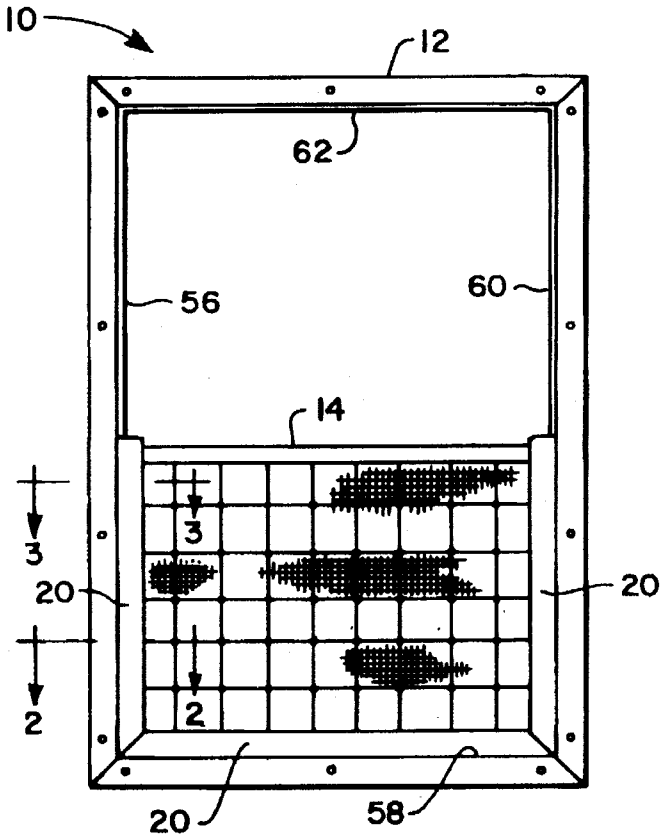
FIG. 1 is a front elevational view of the child saver safety screen apparatus for use with an associated window casing that is in accordance with one form of the invention.

Referring now to FIGS. 1–8 there is shown a preferred form of the child saver safety screen apparatus 10 for an associated window casing in accordance with a preferred form of the invention. The child saver safety screen apparatus 10 includes a frame 12 and a frame 14. The frame 12 attaches to the associated window casing. Frame 14 slides into and interlocks with frame 12. As illustrated in FIG. 1, the frame 12 has inside edges 56, 58, 60 and 62. A C-shaped channel 20 connects to the inside edges 56, 58, and 60 of frame 12 at the point 44. The C-shaped channel 20 extends partially up the edges 56 and 60 of the frame 12. This permits easy removal of the frame 14 in the event of an emergency and access to the associated window is needed, such as in case of a fire. The C-shaped channel 20 contains ends 64 and 66. The spurs 24 and 26 attach to the respective ends 64 and 66. The spurs 24 and 26 extend inwardly toward the C-shaped channel 20. The spurs 24 and 26 are covered with respective slides 28 and 30. The slides 28 and 30 each include a peaked top and allow the frame 14 to align up with the frame 12 when frame 14 is installed as well as permit the frame 14 to slide up and down easily within the frame 12. Although the slides 28 and 30 may be manufactured from any material which is durable and has a smooth surface, such as rubber or silicon based materials, the preferred material is plastic. The C-shaped channel 20, spurs 24 and 26, and slides 28 and 30 are illustrated in cross section in FIGS. 2 and 3. If necessary, braces may be placed between the frame 12 and the C-shaped channel 20 for additional strength and support.

Figure 5:
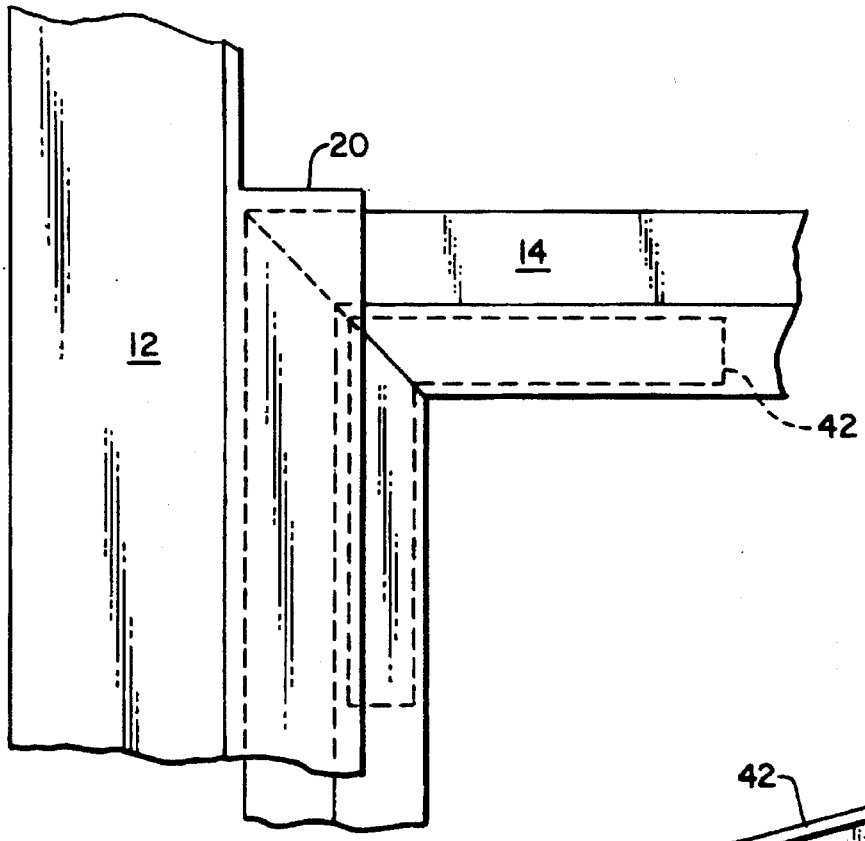
FIG. 5 is a fragmentary front view illustrating the relationship of the second frame to the first C-shaped channel of the first frame and the relationship of the first C-shaped channel to the first frame.
Figure 6:
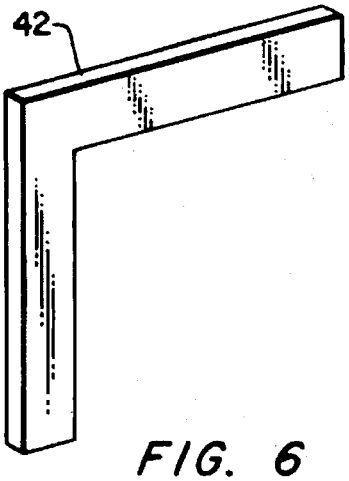
FIG. 6 is a perspective view of the corner spline used to hold the second frame together.

The second frame 14 comprises of J-shaped members 32 and 34. The J-shaped members 32 and 34 are joined intermediate by member 36. The J-shaped member 32 includes an elongated stem 72 and generally arcuate portion 68 and the J-shaped member 34 includes an elongated stem 74 and a generally arcuate portion 70. The elongated stems 72 and 74 are parallel and fixed in a closely spaced relationship and the arcuate portions 68 and 70 are spaced farther apart. The member 36 and the J-shaped members 32 and 34 form a second C-shaped channel 76. The stems 72 and 74 of the J-shaped members 32 and 34 are disposed to define a wedge-shaped slot 38, located opposite the second C-shaped channel 76. The second C-shaped channel 76 contains means for allowing the plurality of fiber strands 16 to pass through. Although holes are the preferred method for allowing the fiber strands 16 to pass through the second C-shaped channel 76, other means, such as slots may be used. The J-shaped members 32 and 34, the elongated stems 72 and 74, the arcuate portions 68 and 70, member 36, the wedge-shaped slot 38 and the second C-shaped channel 76 are illustrated in cross section in FIGS. 2 and 3. The frame 14 is held together by corner splines 42. A corner spline 42 is shown in FIG. 6 and the relationship of the corner spline 42 to the frame 14 is shown in FIG. 5.

The arcuate portions 68 and 70 and a portion of the elongated stems 72 and 74 slide into and interlock with the spurs 24 and 26 and a portion of the first C-shaped channel 20 on the frame 12. The arcuate portions 68 and 70 and a portion of the elongated stems 72 and 74 are in contact with and glide up and down on the slides 28 and 30. The slides 28 and 30 align the arcuate portions 68 and 70 and the elongated stems 72 and 72 in the frame 12. The relation-ship of the spurs 24 and 26, the first C-shaped channel 20 of the frame 12, the arcuate portions 68 and 70 and the elongated stems 72 and 74 is illustrated in great detail in cross-section in FIGS. 2 and 3. Any means, such as safety latches or pins, may be used to prevent a child from inadvertently sliding the frame 14 up and out of the frame 12.

Figure 4:
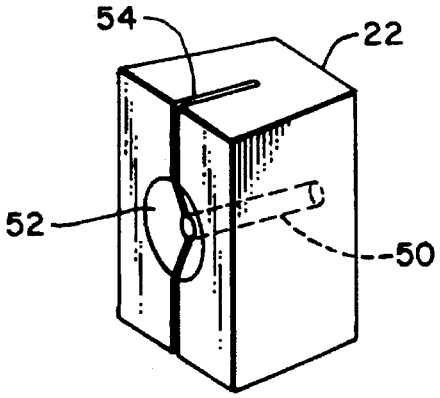
FIG. 4 is a perspective view of the strand anchor.
Figure 7:
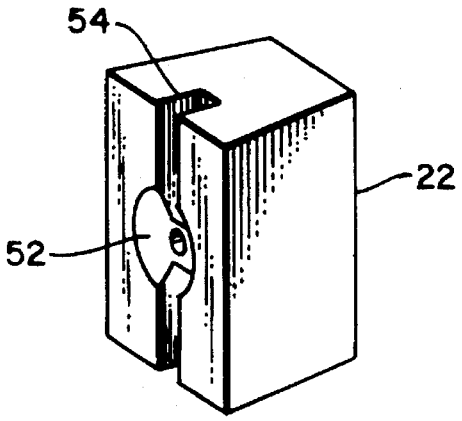
FIG. 7 is a perspective view of a strand anchor for use in the alternate method of stringing the plurality of fiber strands shown in FIG. 8.

The strand anchor 22 is a wedge-shaped block having a hole 50, a counter sink 52 and a slot 54. The hole 50 extends therethrough and is located between the parallel sides of the wedge-shaped strand anchor 22. The counter sink 52 is located on the parallel side of the strand anchor 22 having the larger cross-sectional area. The slot 54 is vertical and passes through the center of the hole 50 and the counter sink 52. The strand anchor is illustrated in FIGS. 4 and 7.

Figure 2:
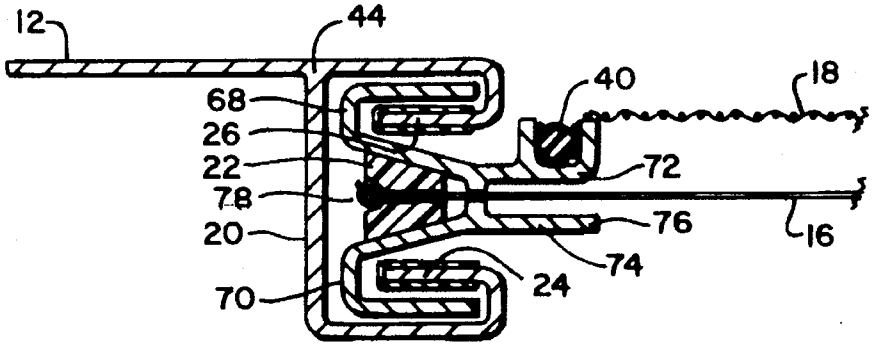
FIG. 2 is a sectional view taken along the line 2—2 in FIG. 1.

A single fiber strand 16 is attached to the frame 14 with the aid of two strand anchors 22 which align up with each other. A single fiber strand 16 is knotted on one end. The opposite end of the strand fiber 16 passes through the hole 50 in the strand anchor 22 and through the member 36 in the frame 14. The fiber strand 16 is stretched across the frame 14, passed through the opposite member 36 and the hole 50 in the opposite strand anchor 22 and is held in place by knotting the opposite end of the fiber strand 16. The fiber strand 16 is under tension, causing the strand anchors 22 to lock into the wedge-shaped slot 38 in the frame 14. The knot 78 of the fiber strand 16 fits into the counter sink 52 of the strand anchor 22, resulting in the knot 78 being flush with the side of the strand anchor 22. This is illustrated in FIG. 2. The fiber strands 16 are disposed in a first set and a second set. Each set is generally mutually parallel and the first set is generally perpendicular to the second set. This is shown in FIGS. 1 and 8.

Figure 8:
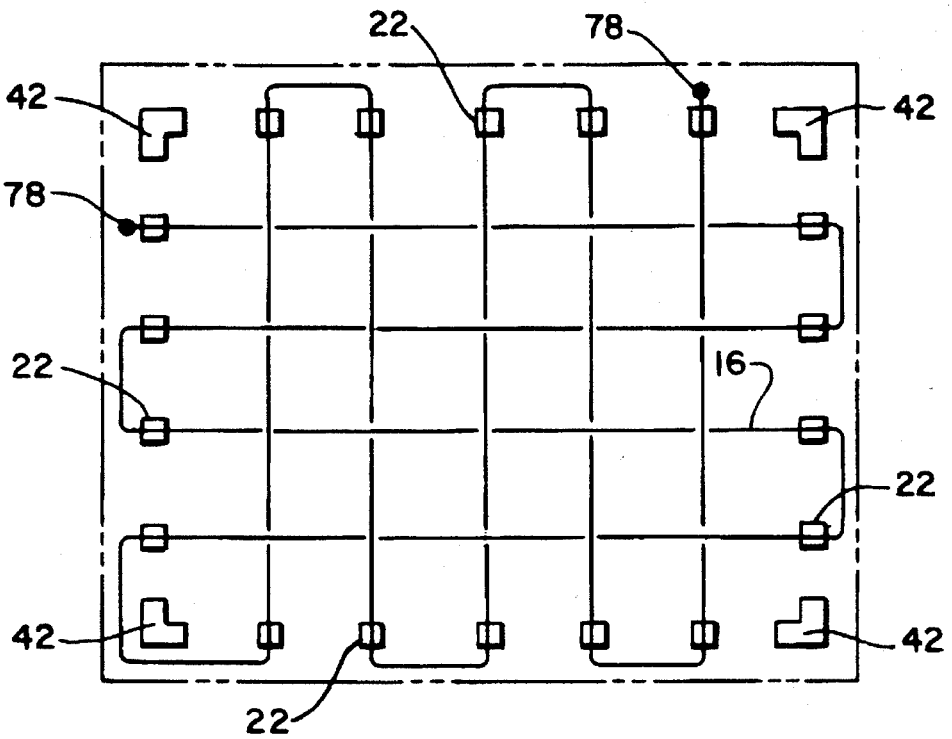
FIG. 8 is an illustration of an alternate method of stringing the plurality of fiber strands using the strand anchors as shown in FIG. 7.

FIG. 8 illustrates an alternate method for stringing the frame 14 similar to the stringing of a tennis racket. The alternate method comprises of using a single fiber strand 16 to create the first set and the second set. One end of the fiber strand 16 is knotted and passes through the hole 50 of the strand anchor 22 and the member 36 of the frame 14 as above. The fiber strand 16 passes through the hole 50 and the counter sink 52 in the opposite strand anchor 22, bent ninety degrees and seats in the slot 54. The fiber strand 16 then passes through the strand anchor 22 adjacent to the previous strand anchor 22 and the weaving pattern continues until the first set and then the second set is completed. The fiber strand 16 is tied off after passing through the last strand anchor 22 to complete the alternate stringing method. In the alternate method, the first set and second set are disposed generally mutually parallel to each other, and the first set is perpendicular to the second set. In the alternate method as illustrated in FIG. 8, the first set is strung on the frame 14. The fiber strand 16 is then looped around one of the corner splines 42 of the frame 14 and the second set is strung. Although any type of strand 16 may be used, the preferred strand 16 is either a braided strand or a monofilament strand.

Figure 3:
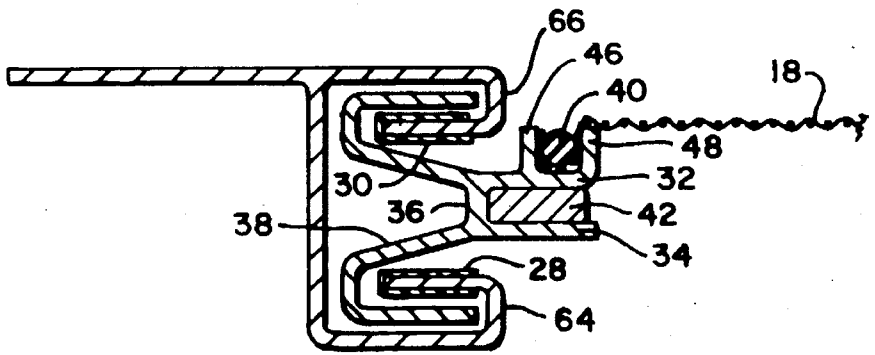
FIG. 3 is a sectional view taken along the line 3—3 in FIG. 1.

The stem 72 has projections 46 and 48 that are parallel to each other and perpendicular to the stem 72 in cross section. This is illustrated in FIGS. 2 and 3. The projections 46 and 48 are generally dimensioned and configured to accept the width of a vinyl spline 40. The conventional window screen 18 is stretched across the frame 14 and is held in place by pressing the vinyl spline between the projections 46 and 48.

Although the apparatus 10 has been described as an aftermarket unit to be installed to an existing window attached to a building or house, the apparatus 10 can also be incorporated into a newly manufactured window at the window factory. In this instance the C-shaped channel 20, the spurs 24 and 26 and the slides 28 and 30 are incorporated into the window casing. The C-shaped channel 20 would extend partially up the sides of the window casing and the frame 14 described above would slide into the C-shaped channel 20.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A child saver safety screen apparatus for use with an associated window casing which comprises:

a first generally rectangular frame having a first side, a second side, a third side and a fourth side, said first side, second side, third side and fourth side each have respective outside edges and inside edges;

a second generally rectangular frame having a first side, a second side, a third side and a fourth side, said first side, second side, third side and fourth side are joined together with respective corner splines;

a plurality of fiber strands;

a generally rectangular conventional window screen;

means for interlocking said second frame to said first frame, said means for interlocking said second frame to said first frame includes a first channel, said first channel connects to said inside edges of said first, second, and third sides of said first frame, said first channel has a C-shape cross section and a first end and a second end, said first channel having a C-shape cross section and a first end and a second end;

means for mounting said plurality of fiber strands in substantially parallel relationship in said second frame; and means for connecting the conventional window screen to said second frame, said first C-shaped channel including spurs located on said first end and said second end thereof, said spurs extend inwardly toward said first C-shaped channel, said second frame including a first J-shaped member and a second J-shaped member, each said J-shaped member includes an elongated stem and an arcuate portion, said stems being fixed in closely spaced relationship with said arcuate portions spaced farther apart as viewed in cross section, said first and second J-shaped members forming a second C-shaped channel.

2. The apparatus as described in claim 1 wherein:

said first J-shaped member and said second J-shaped member have the stems thereof disposed to define a wedge-shaped slot.

3. The apparatus as described in claim 2 wherein:

said means for interlocking further includes said second frame sliding into said first frame whereby said arcuate portions of said first and second J-shaped members of said second frame lock with said C-shaped channel and said spurs of said first frame.

4. The apparatus as described in claim 3 wherein:

said means for connecting said plurality of strands to said second frame includes a plurality of strand anchors, said strand anchors being wedge-shaped.

5. The apparatus as described in claim 4 wherein:

said plurality of strand anchors have a hole therethrough with a counter sink and a vertical slot, said hole located between the two parallel sides of said wedge-shaped strand anchor and said counter sink located on said parallel side of said strand anchor having the larger cross-sectional area.

6. The apparatus as described in claim 5 wherein:

said vertical slot passes through the center of said counter sink and said hole.

7. The apparatus as described in claim 6 wherein:

said means for connecting said plurality of fiber strands further includes said fiber strands passing through said second C-shaped channel of said second frame, through said hole and said counter sink in said strand anchors, said means for connecting placing each of said fiber strands under tension to force said wedge-shaped strand anchors to lock into said wedge-shaped slot in said second frame.

8. The apparatus as described in claim 6 wherein:

said plurality of fiber strands are disposed in first and second sets, each said set being generally mutually parallel and said first set being substantially perpendicular to said second set.

9. The apparatus as described in claim 1 wherein:

said means for connecting said generally rectangular standard window screen to said second frame includes a first projection and a second projection, said first and second projections are located on said first J-shaped member of said second frame.

10. The apparatus as described in claim 9 wherein:

said apparatus further includes a vinyl spline;

said first projection and said second projection are disposed generally parallel to each other, forming a U-shaped slot between said first and second projections as viewed in cross-section, said U-shaped slot being dimensioned and configured to accept said vinyl spline.

11. The apparatus as described in claim 10 wherein:

said generally rectangular standard window screen is held in place on said second frame by said vinyl spline pressed into said U-shaped slot.

* * * * *